United States Patent [10]

Samuelsson

[11] 4,046,284

[45] Sept. 6, 1977

[54] TENNIS BALL CONTAINER INDICATING PLAYERS TURNS

[76] Inventor: Frank A. Samuelsson, 738 Ruby St., Redwood City, Calif. 94061

[21] Appl. No.: 647,896

[22] Filed: Jan. 9, 1976

Related U.S. Application Data

[63] Continuation of Ser. No. 513,098, Oct. 8, 1974, abandoned.

[51] Int. Cl.[2] ..... B65H 1/00

[52] U.S. Cl. ..... 221/45; 273/29 R; 221/281; 221/283; 221/303

[58] Field of Search ..... 221/64, 281-283, 221/303, 307, 309, 310, 33, 45, 61, 63, 62; 224/50; 273/148 R, 29 R, 32 R, 32 D, 1 R, 30; 248/311; 211/49 D; 312/45, 49

[56] References Cited

U.S. PATENT DOCUMENTS

| | | | |
|---|---|---|---|
| 1,719,769 | 7/1969 | Kaufman | 248/311 |
| 3,002,651 | 10/1961 | Gauld | 312/45 |
| 3,777,933 | 12/1973 | Joliot | 221/309 |

FOREIGN PATENT DOCUMENTS

| | | | |
|---|---|---|---|
| 553,410 | 11/1942 | United Kingdom | 221/307 |

*Primary Examiner*—Robert B. Reeves
*Assistant Examiner*—H. Grant Skaggs
*Attorney, Agent, or Firm*—Julian Caplan

[57] ABSTRACT

To avoid disputes as to which players have the next turn to use a tennis court, a container is mounted at a convenient location such as on the fence surrounding the court. The player deposits a suitably distinctively marked ball in the open top of the container, resting on previously deposited balls. A stop spaced below the open bottom of the container prevents balls from dropping out. The gap between the stop and the bottom edge of the container is slightly less than the diameter of the ball; however, when the bottom ball is pulled, it distorts sufficiently to pemit removal.

2 Claims, 4 Drawing Figures

TENNIS BALL CONTAINER INDICATING PLAYERS TURNS

This is a continuation of application Ser. No. 513,098, filed Oct. 8, 1974 and now abandoned.

This invention relates to a new and improved tennis ball container indicating players' turns. More particularly, the invention provides a dispenser or container for several tennis balls and is used to establish the order of reservation for one or more tennis courts, thereby avoiding disputes as to whose turn is next. As a doubles or pair of players arrive at the courts, a single ball suitably marked to indicate the owner is dropped into the top of the dispenser on top of the balls of the previous players. When a court is vacant, the owner of the bottom ball removes it from the dispenser. Thus the present invention provides a very simple inexpensive device to indicate the turns of the various players awaiting use of the courts.

A feature of the invention is the fact that it accommodates a plurality of balls, preferably four or eight, and thus may serve to handle several tennis courts with a single dispenser.

A feature of the invention is the fact that the balls in the container are visible from various angles so that waiting players can readily observe how many players are ahead of them.

A still further feature of the invention is the fact that it is easily mounted in a convenient location, preferably on the wire fence conventionally surrounding tennis courts.

Other objects of the present invention will become apparent upon reading the following specification and referring to the accompanying drawings in which similar characters of reference represent corresponding parts in each of the several views.

Figure 1:
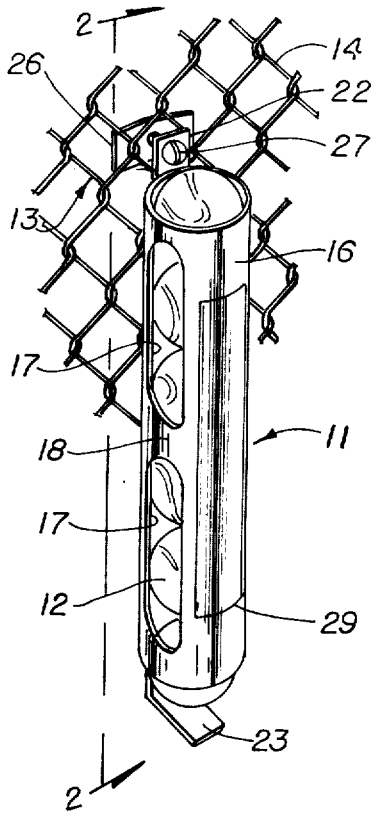
FIG. 1 is a perspective view showing one form of the invention mounted on a fence.
Figure 2:
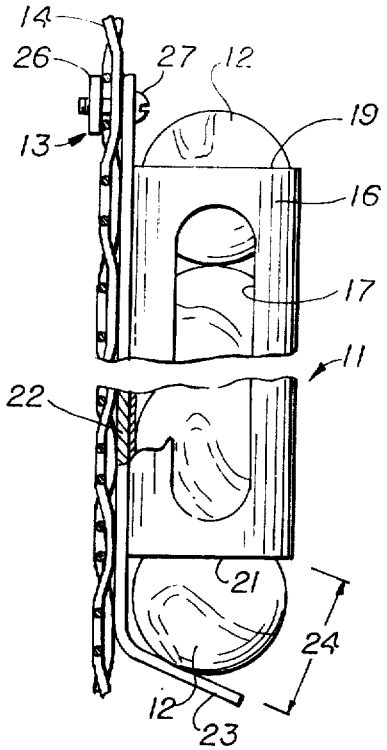
FIG. 2 is an enlarged vertical sectional view taken substantially along the line 2—2 of FIG. 1 partly broken away to conserve space.

Directing attention first to FIGS. 1 and 2, ball container 11 holds a plurality of tennis balls 12 and is fastened by means of attachment means 13 to a fence 14 or other suitable location.

Container 11 has a cylindrical member 16 having an inside diameter slightly greater than the diameter of ball 12. It is preferably formed of a tube metal which is either seamed or seamless. Elongated windows 17 are pierced in the side of the cylinder 16 so that the balls are visible and cannot escape from inside the cylinder. In the form of the invention shown in FIG. 1, there are two vertically spaced apart windows 17 one of each side separated by a strengthening divider 18. Such a construction accommodates eight tennis balls, but it will be understood that the length of cylinder 16 and the number of windows 17 is subject to variation. The top end 19 of cylinder 16 is open so that the players can drop the balls into the opened top end. The bottom end 21 is also open. Attached to the back of cylinder 16 is an elongated metal bracket 22 which projects above and below the ends 19 and 21. The lower end of bracket 22 is formed with a downwardly-out-wardly slanted stop 23. The lowermost ball 12 rests on the stop 23. The gap 24 between the bottom edge 21 and the stop 23 is slightly less than the diameter of ball 12. Thus a conventional tennis ball 12 has a diameter of 2½ inches and the gap 24 is preferably 2¼ inches.

The bracket 22 may be mounted on fence 14 or other location. A preferred means uses a clamping plate 26, which is a rectangular piece of steel centrally apertured and fitting behind the fence 14. Screw 27 passes through an aperture in the upper end of bracket 22 and also through the fence and through a tapped hole in the clamping plate 26. Preferably, screw 27 is a "one-way screw" so that it cannot be mischievously removed. Although not shown in the drawings, it will be understood that a similar clamping plate 26 may be installed at the bottom of bracket 22.

The forward face of cylinder 16 comprises a panel which is wide enough and long enough so that a label 29 may be applied which indicates instructions for use of the device.

The container 11 of FIGS. 1 and 2 may be constructed in various manners. Thus the cylinder 16 is preferably of a mild steel and is welded or riveted to bracket 22.

Figure 3:
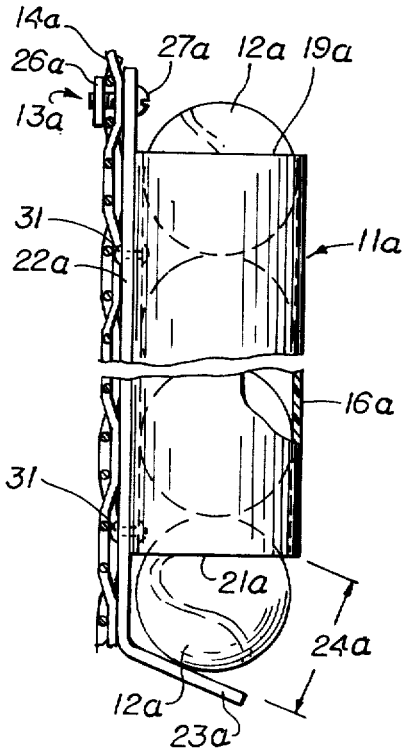
FIG. 3 is a view similar to FIG. 2 of a modified construction.

The modification of FIG. 3 employs a clear plastic cylinder 16*a* which is attached to bracket 22*a* by means of rivets 31 or other suitable means. Since the cylinder 16*a* is transparent, it is necessary to form the equivalent of the windows 17 of FIG. 1.

Figure 4:
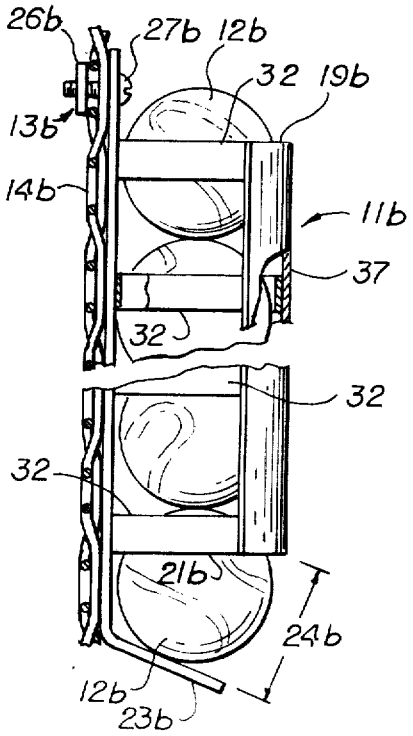
FIG. 4 is a view similar to FIG. 2 of a still further modified construction.

In the modification of FIG. 4, a plurality of vertically spaced apart circular straps 32 are employed and are welded riveted or otherwise attached to bracket 22*b*. Preferably, an arcuate front plate is welded to the front of all of the straps 32, rigidifying the same and also providing a suitable location for a lable (not shown).

The structures of FIGS. 3 and 4 are generally similar to those of FIGS. 1 and 2, and the same reference numerals followed by subscripts *a* and *b* respectively are used to designate corresponding elements.

What is claimed is:

1. A tennis ball container for indicating players' turns wherein a player deposits a tennis ball having distinguishing characteristics in the top of the container and later withdraws the ball from the bottom of the container after other players have withdrawn previously deposited balls, whereby the order of balls in the container from bottom to top indicates players' turns, said container comprising a cylindrical member of a length at least as great as the diameter of two balls having an inside diameter slightly greater than the normal diameter of the balls to be contained, the top of said cylindrical member being open and unobstructed for deposit of balls, the bottom of said cylindrical member being open, and attachment means rigidly fixed to said cylindrical member to mount said cylindrical member in upright position, at least a portion of said cylindrical member being apertured so that view of all the balls in the interior of said cylindrical member is unobstructed from approximately 300° angle about the axis of said cylindrical member so that players may observe all the balls within said container, said attachment means being unitary and comprising a rigid vertical elongated metal bracket and a stop comprising an outwardly bent rigid lower end of said bracket bent downwardly-outwardly relative to said bracket, said stop being fixedly secured below said cylindrical member with a fixed gap between the lower end of said cylindrical member and said stop which is at no position greater than said normal diameter, the width of said stop being approximately one-third the diameter of said cylindrical member so that a ball may be withdrawn from said container by pulling said ball from the front or from either side, the ball distorting in shape so as to be pulled through said gap, said attachment means further comprising a clamping plate adapted to be positioned on the side of a wire fence opposite said bracket and bolts connecting said bracket and plate and passing through said fence to secure said bracket and clamping plate together to mount said container on said fence.

2. A container according to claim 1 in which said cylindrical member is formed on its front side with a vertically elongated face and a label affixed to said face.

* * * * *